United States Patent [19]

Crompton

[11] Patent Number: 4,759,551

[45] Date of Patent: Jul. 26, 1988

[54] COIN PROJECTING AMUSEMENT DEVICE

[75] Inventor: Gordon J. Crompton, Burchington, United Kingdom

[73] Assignee: Crompton Machine Company Limited, Kent, England

[21] Appl. No.: 62,909

[22] Filed: Jun. 16, 1987

[30] Foreign Application Priority Data

Jun. 19, 1986 [GB] United Kingdom ..... 8614903

[51] Int. Cl.[4] ..... A63F 7/02; A63F 7/28; A63F 7/38

[52] U.S. Cl. ..... 273/355; 273/357; 273/366; 273/377

[58] Field of Search ..... 273/355, 356, 357, 366, 273/371, 377

[56] References Cited

U.S. PATENT DOCUMENTS

| | | | |
|---|---|---|---|
| 649,814 | 5/1900 | Coker, Jr. | 273/355 |
| 1,646,095 | 10/1927 | Junker | 273/377 |
| 4,241,925 | 12/1980 | Watanabe | 273/316 |
| 4,272,082 | 6/1981 | Shoemaker, Jr. | 273/356 |
| 4,303,248 | 12/1981 | Shoemaker, Jr. et al. | 273/356 |
| 4,487,414 | 12/1984 | Kärkkäinen et al. | 273/371 |
| 4,496,160 | 1/1985 | Wichinsky et al. | 273/369 |

*Primary Examiner*—Anton O. Oechsle

*Attorney, Agent, or Firm*—McAulay, Fields, Fisher, Goldstein & Nissen

[57] ABSTRACT

The invention provides a coin operated amusement machine, comprising a continuously movable band (1) which defines a play field (8), means (7, 9) for projecting coins (6) onto the play field, sensor means for detecting whether coins occupy defined areas on the play field, and dispensing means for dispensing a cash or non-cash prize in response to a signal from the sensor means.

6 Claims, 7 Drawing Sheets

COIN PROJECTING AMUSEMENT DEVICE

This invention relates to a coin-operated amusement machine. In the context of this specification, the term "coin" is understood to mean both conventional coins and also coin-shaped tokens of no monetary value.

The invention provides a coin-operated amusement machine, comprising a continuously movable band defining a play field, means for projecting coins onto the play field, sensor means for detecting whether coins occupy defined areas on the play field, and dispensing means for dispensing a cash or non-cash prize in response to a signal from the sensor means.

The continuously movable band preferably has a flat portion defining the play field suspended between first and second parallel spaced apart rollers, and coins are projected onto the play field adjacent the first roller and conveyed towards the second roller by the band, and drop off the band as it passes over the second roller.

The means of projecting coins onto the play field preferably comprises a coin magazine supported above the play field and containing a line of coins supported edge to edge and sloping downwardly towards the first roller, the lowermost coin being held by a releasable barrier which can be actuated to release coins one at a time from the lower end of the magazine onto the play field. The lower end of the coin magazine is preferably combined with a coin release and guidance mechanism, which is movable by a player of the machine to guide a released coin towards a desired part of the play field and which includes means for actuating the releaseable barrier in the coin magazine.

The machine preferably incorporates a vertical conveyor for conveying coins which have dropped off the play field and/or which have been inserted by a player into the machine from a lower coin-collecting station to an upper coin-distribution station, from which coins can be dispensed into the upper end of the coin magazine.

The machine preferably incorporates means operable by the player for selecting a cash pay-out or a non-cash prize when a coin has been projected onto a defined area of the play field.

A preferred embodiment of a coin operated amusement machine according to the invention is now described with reference to the accompanying drawings, in which.

Figure 1:
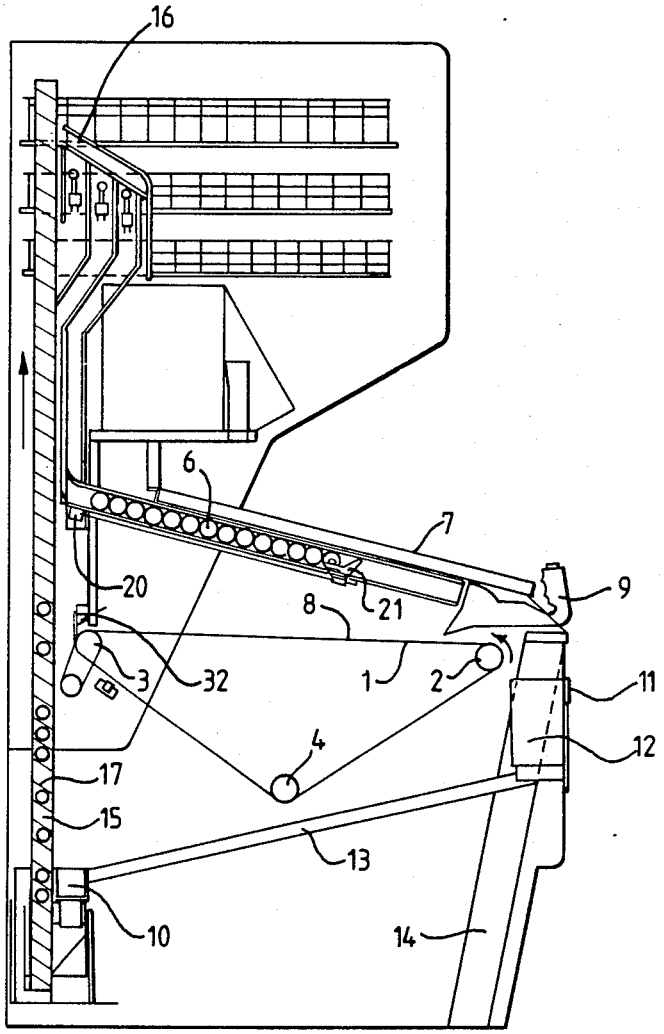
FIG. 1 is a diagrammatic side view of the machine.
Figure 2:
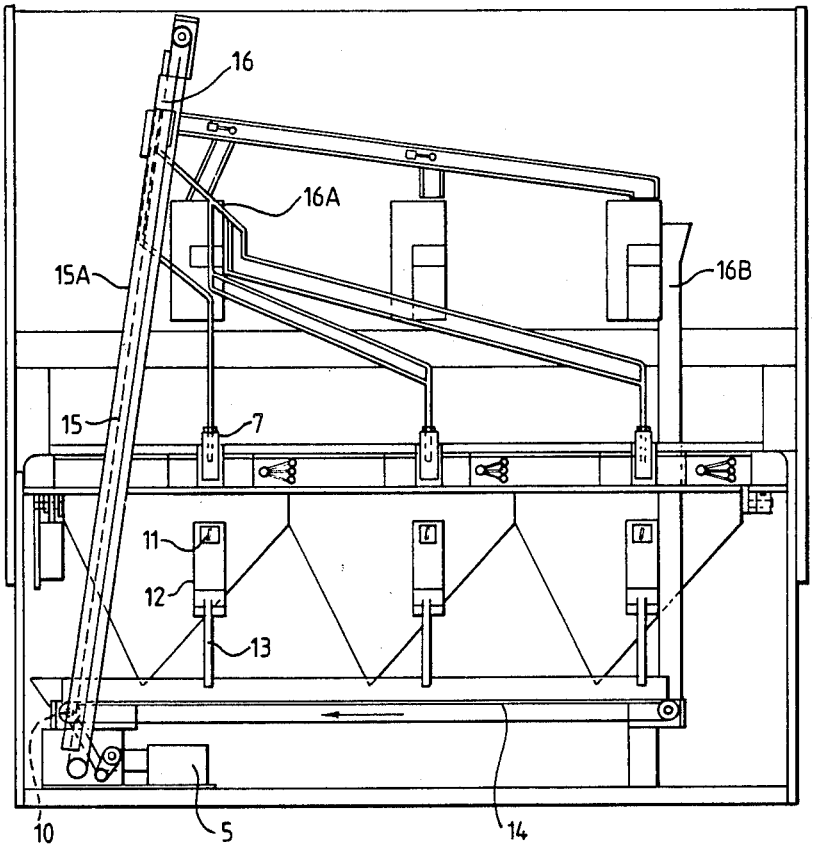
FIG. 2 is a diagrammatic front view corresponding to FIG. 1.

Referring first to FIGS. 1 and 2, a continuously movable band 1 is supported by a first upper roller 2, a second upper roller 3 and a lower roller 4. The roller 3 is driven by a motor 5 through a conventional drive and gearing mechanism.

Coins 6 are supported edge to edge in a sloping coin magazine 7 above the play field 8 which is defined as the upper flat surface of the continuously movable band. At the lower end of the coin magazine is a coin gun 9 described in more detail below, actuation of which releases coins one at a time from the lower end of the coin magazine onto the play field adjacent the first roller 2. As the band moves over the rollers in the direction shown by the arrow, the coins are conveyed towards the second roller 3, and then drop off the end of the play field and fall into a coin collecting station 10.

In order to operate the machine, the player inserts a coin through a coin slot 11 in the front of the machine and the coin then falls into a coin sorting box 12, for example Coin Acceptor MS111 and Coin Separator MS 125 manufactured by Mars Money Systems, Winnerish, Triangle, Wokingham, Berks. In this description, reference is made to coins which are currently in use in the United Kingdom. However, the machine can equally well be operated with different kinds of coins, or with coin shaped tokens. The coins housed in the coin magazine 7 and projected onto the play field are 10 pence pieces. If a player inserts a single 10 pence piece into the coin slot 11, then the control panel (FIG. 7) will indicate that a preset number of plays can be made, and the coin gun can be actuated that number of times. It the player inserts a larger denomination coin, then a corresponding number of plays can be made. Any 10 pence pieces inserted into the coin sorting box 12 will be selected and allowed to drop via a coin slide 13 into the coin collecting station 10. Coins other than 10 pence pieces inserted into the box 12 will drop via a chute 14 into a coin box in the lower part of the machine, from which they may be recovered from time to time by the machine operator.

The machine may have stations to permit use by more than one player at a time. In the embodiment shown in FIG. 2, three playing stations are provided. There are accordingly a corresponding number of coin magazines and coin entry slots and associated items. 10 pence pieces which pass down the coin slides 13 drop onto a cross feed conveyor 14 which is driven by the motor in the direction shown by the arrow. This conveys the coins to the coin collecting station 10.

Figure 3:
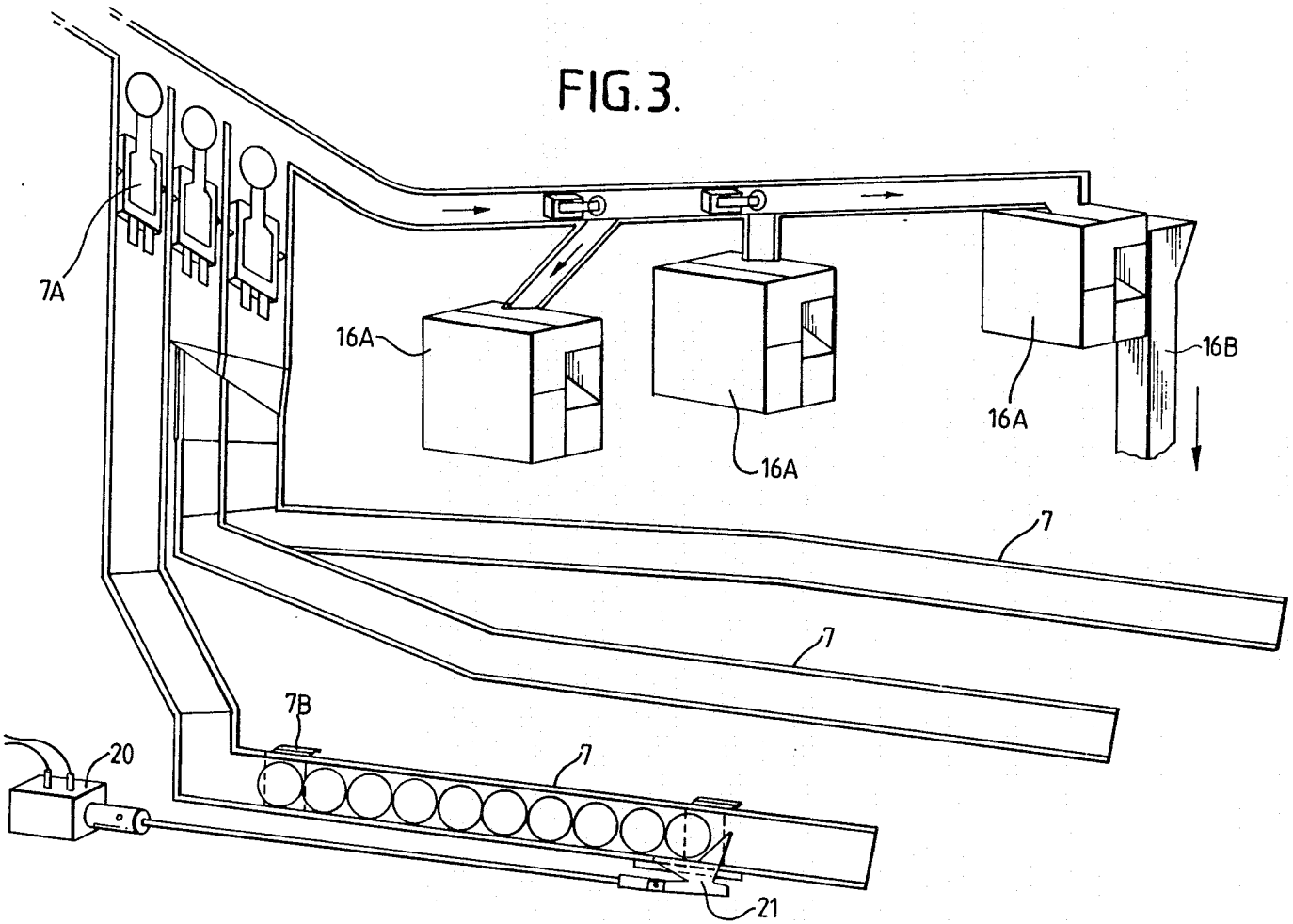
FIG. 3 is a perspective view of the coin distribution station and coin magazine.

A vertical coin conveyor 15 transfers coins from the lower coin collecting station 10 to the upper coin distribution station 16, which is shown in more detail in FIG. 3. The vertical conveyor is a continuously moving band which rises at an angle close to the vertical as shown in FIG. 2. The band has angled shoulders 17 which are spaced so as to accommodate a single 10 pence coin in between them. On its upward flight, the band passes between walls 15A so that coins which pass onto the band at the coin collecting station 10 are carried upwardly by the band until the end of the walls alongside the band, whereupon the coins roll off the band into the upper coin distribution station 16. The coin distribution station comprises a slightly sloping channel along which coins can roll in the directions shown by the arrows in FIG. 3. Along this channel are entrances to substantially vertical coin chutes leading to the coin magazines and coin hoppers 16A (eg. "Universal" Hopper, manufactured by Coin Controls Ltd, Royton, Oldham, Lancs) for containing coins used in cash payouts. At the top of each coin chute leading to a coin magazine, there is a coin blocking mechanism 7A which can be actuated in response to a coin sensor 7B in the magazine, which indicates when the magazine is full. Thus, when these blocking means are actuated, coins will not pass into the coin magazines, but instead will pass into the coin hoppers 16A. When the hoppers are full, any excess coins from the coin distribution station are fed into a chute 16B leading to a cash box in the base of the machine.

Figure 4:
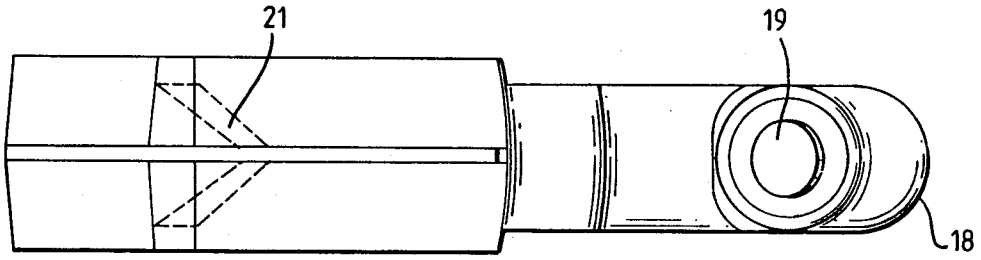
FIG. 4 is a top view of a coin release and guidance mechanism.
Figure 5:
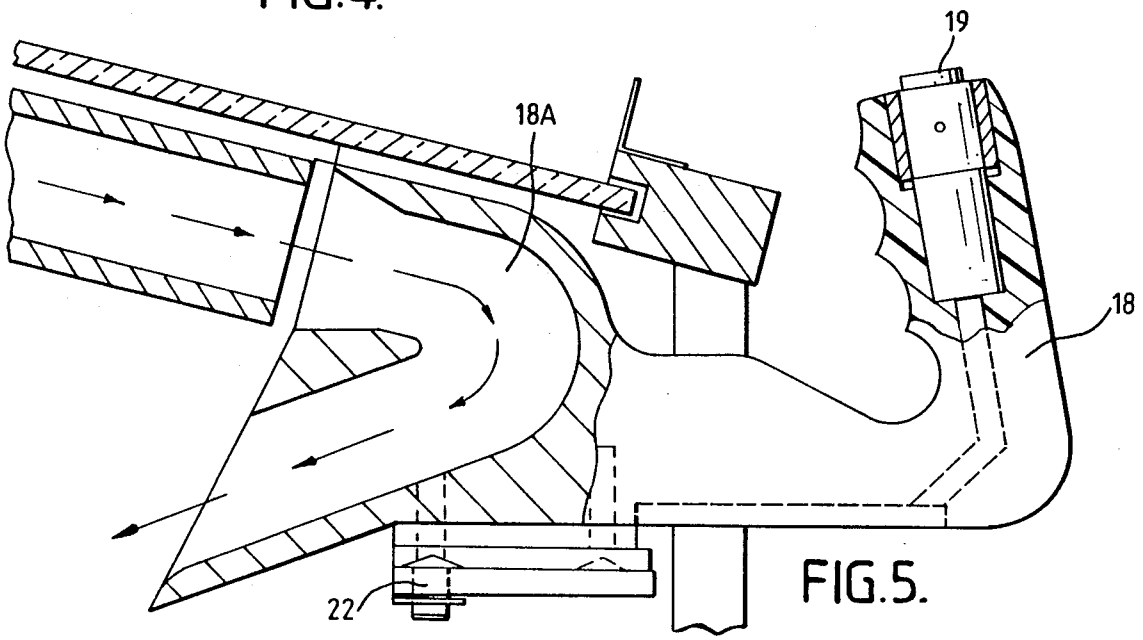
FIG. 5 is a side view corresponding to FIG. 4.

The coin gun 9 is shown in more detail in FIGS. 4 and 5. It incorporates a handle 18 having a "fire" button 19. When this button is pressed, it operates a solenoid release 20 which causes a coin blocking mechanism 21 at the lower end of the coin magazine to be retracted, thereby releasing a single coin from the lower end of the magazine, after which the line of coins in the magazine is again blocked. The released coin falls from the end of the coin magazine into a U-shaped channel 18A in the coin gun, following the direction of the arrows shown in FIG. 5. The coin is then projected forwardly from the gun onto the play field in the general direction of movement of the play field. So as to guide the coin towards the desired part of the play field, the coin gun is capable of swivelling around a vertical pivot 22.

Figure 6:
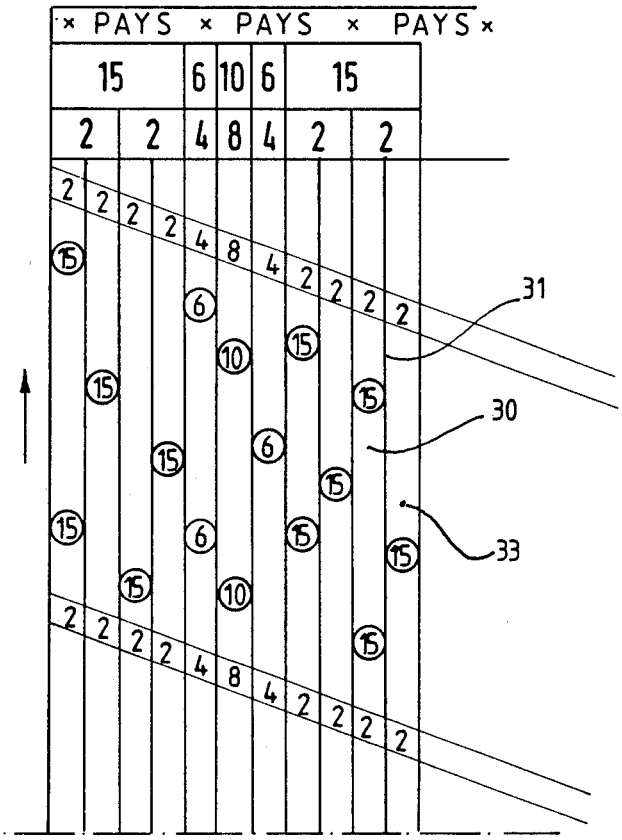
FIG. 6 is a top view of the play field.

FIG. 6 shows a preferred layout of the play field on the continuously moving band 1. The play field is divided up into a plurality of strips 30 by continuous lines 31 drawn parallel to the direction of movement. In order to win a prize, a coin must come to rest flat on the play field between the lines. The prizes can vary as shown depending on which lines the coin comes to rest between. The position of a coin on the play field is sensed by a plurality of finger contacts 32 in line behind the back panel of the machine. When a coin is located flat on the play field between two lines, then as it passes behind the back panel it bridges the pair of finger contacts relating to those lines, and this signals a win. Wins of a higher value can be obtained by causing coins to come to rest at defined spots within the winning strips. This is achieved by providing a reflective dot 33 on the winning strip just ahead of the winning spot. A higher pay-out is then triggered if the coin touches the finger contacts at the same time as the reflective dot is in line with a sensor below the moving band.

Figure 7:
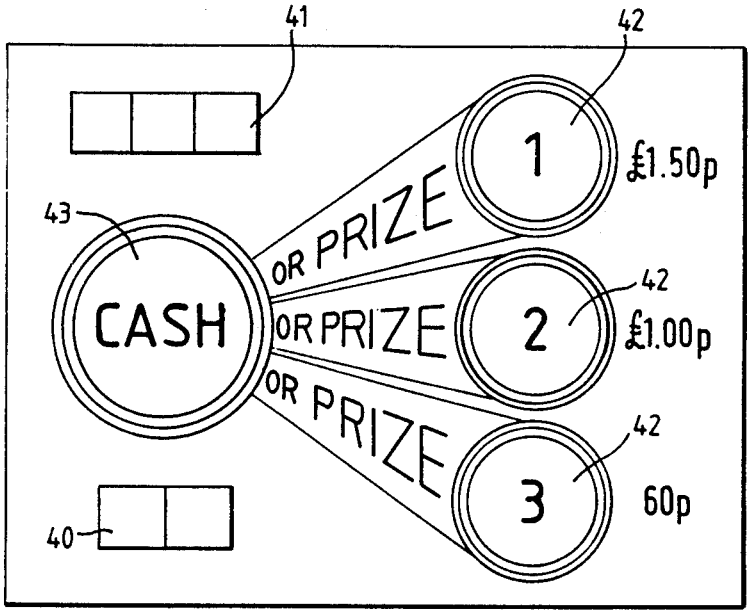
FIG. 7 is a view of the control panel showing the prize selection means.

FIG. 7 shows the control panel on the front of the machine. The number of credits in display 40 indicates the number of times the coin gun may be operated and depends on the coins inserted into the machine. A particular feature of the machine is that it provides a choice to the player between having a cash payout or taking a non-cash prize. As wins are recorded on the play field, the cash value of the prizes won is indicated on the control panel in display 41. Wins can be stored until the value of one of the non-cash prizes is reached, whereupon the player can press one of the three buttons 42 to obtain one of the non-cash prizes. Alternatively, the player can press the cash button 43 to obtain a cash payout at any time.

Figure 8:
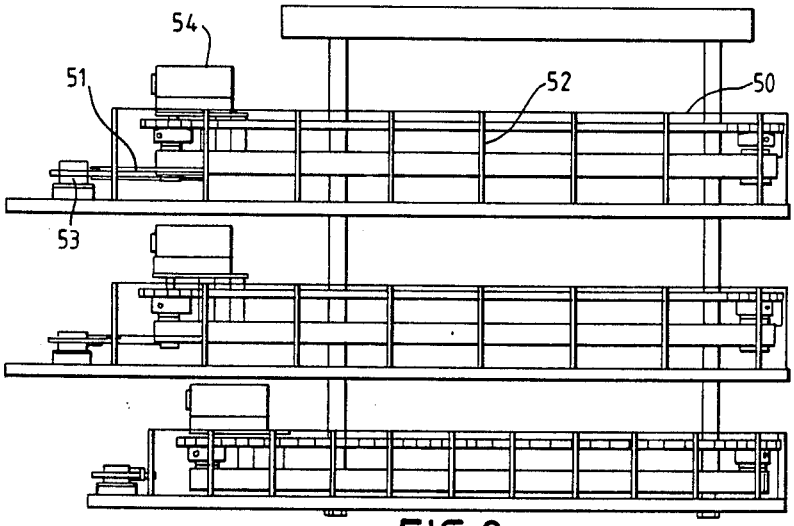
FIG. 8 is a side view of the prize dispenser unit.
Figure 9:
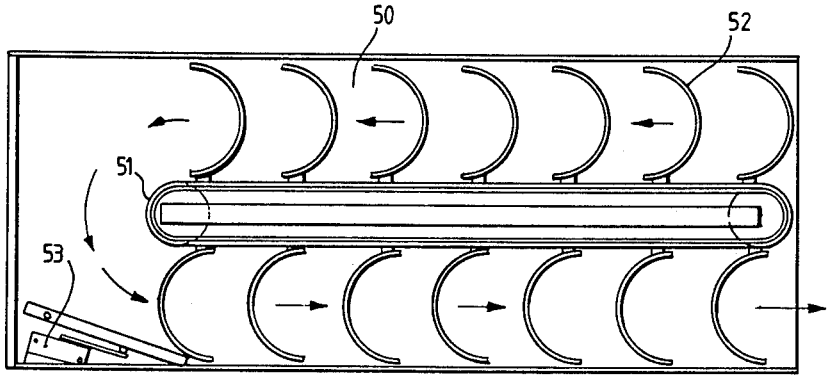
FIG. 9 is a top view corresponding to FIG. 8.

FIGS. 8 and 9 show the dispenser unit for non-cash prizes. In this particular embodiment, there are non-cash prizes of three different values. The prizes of each respective value are housed in horizontal conveyor systems 50 at three respective levels. These conveyors are driveable by a chain and sprocket drive 51 and the prizes are positioned between separators 52 at each level. When sufficient cash has been accumulated as wins, and one of the prize buttons is pressed, then a microswitch 53 causes the appropriate conveyor to drive forward so as to dispense a single prize to the player, after which the driving motor 54 stops.

I claim:

1. A coin operated amusement machine, comprising a continuously movable band, means for projecting coins onto the band, sensor means for detecting whether coins occupy defined areas on said band, and dispensing means for dispensing a cash or non-cash prize in response to a signal from the sensor means.

2. A machine according to claim 1, in which the continuously movable band has a flat portion defining a play field suspended between first and second parallel spaced apart rollers, whereby coins can be projected onto the playfield adjacent the first roller and conveyed towards the second roller by the band, and thereafter drop off the band as it passes over the second roller.

3. A machine according to claim 2, in which the means for projecting coins onto the playfield comprises a magazine supported above the play field and containing a line of coins supported edge to edge and sloping downwardly towards the first roller, the lowermost coin being held by a releasable barrier which can be actuated to release coins one at a time from the lower end of the magazine onto the play field.

4. A machine according to claim 3, in which the lower end of the coin magazine is combined with a coin release and guidance mechanism, which is movable by a player of the machine to guide a released coin towards a desired part of the playfield and which includes means for actuating the releasable barrier in the coin magazine.

5. A machine according to claim 1, incorporating a vertical conveyor for conveying coins which have dropped off the play field and/or which have been inserted by a player into the machine from a lower coin collecting station to an upper coin distribution station; from which coins can be dispensed into the coin magazine.

6. A machine according to claim 1, incorporating means operable by the player for selecting a cash payout or a non-cash prize when a coin has been projected onto a defined area of the play field.

* * * * *